US009934735B2

(12) United States Patent
Wei et al.

(10) Patent No.: US 9,934,735 B2
(45) Date of Patent: Apr. 3, 2018

(54) DISPLAY CONTROL METHOD AND ELECTRONIC DEVICE

(71) Applicants: Beijing Lenovo Software Ltd., Beijing (CN); Lenovo (Beijing) Co., Ltd., Beijing (CN)

(72) Inventors: Binbin Wei, Beijing (CN); Xueyuan Zhang, Beijing (CN); Haifang Tan, Beijing (CN); Shi Chen, Beijing (CN)

(73) Assignees: BEIJING LENOVO SOFTWARE LTD., Haidian District, Beijing (CN); LENOVO (BEIJING) CO., LTD., Haidian District, Beijing (CN)

( * ) Notice: Subject to any disclaimer, the term of this patent is extended or adjusted under 35 U.S.C. 154(b) by 4 days.

(21) Appl. No.: 14/079,046

(22) Filed: Nov. 13, 2013

(65) Prior Publication Data

US 2014/0132486 A1 May 15, 2014

(30) Foreign Application Priority Data

Nov. 13, 2012 (CN) ..... 2012 1 0452824
Nov. 20, 2012 (CN) ..... 2012 1 0473453

(51) Int. Cl.
*G09G 3/36* (2006.01)

(52) U.S. Cl.
CPC ..... *G09G 3/3611* (2013.01); *G09G 2356/00* (2013.01)

(58) Field of Classification Search
None
See application file for complete search history.

(56) References Cited

U.S. PATENT DOCUMENTS

2004/0095369 A1 5/2004 Takeuchi
2007/0120762 A1* 5/2007 O'Gorman ..... G06F 1/1616 345/1.1

(Continued)

FOREIGN PATENT DOCUMENTS

CN 2904107 5/2007
CN 1384428 10/2012

(Continued)

OTHER PUBLICATIONS

First Office Action dated Feb. 24, 2016 out of Chinese priority Application No. 201210452824.3 (13 pages including English translation).

(Continued)

*Primary Examiner* — Amr Awad
*Assistant Examiner* — Donna Lui
(74) *Attorney, Agent, or Firm* — Brinks Gilson & Lione; G. Peter Nichols

(57) ABSTRACT

A display control method and an electronic device are described. The electronic device includes a first body and a second body. Two sides of the first body include a first display area and a second display area respectively. The method includes: acquiring space position information of the first body and the second body, determining whether the space position information satisfies a first space predetermined condition, and obtaining a first determining result; detecting a first included angle between the first body and the second body if the first determining result indicates that the space position information satisfies the first space predetermined condition; determining whether the first included angle satisfies a first included angle predetermined condition, and switching an operating state of the electronic device to the triangle supporting state if the first included (Continued)

angle satisfies the first included angle predetermined condition.

15 Claims, 6 Drawing Sheets

(56) References Cited

U.S. PATENT DOCUMENTS

| | | | | |
|---|---|---|---|---|
| 2009/0244832 | A1* | 10/2009 | Behar et al. | 361/679.55 |
| 2009/0303676 | A1* | 12/2009 | Behar | G06F 1/162 361/679.27 |
| 2010/0064536 | A1* | 3/2010 | Caskey et al. | 33/303 |
| 2010/0085274 | A1* | 4/2010 | Kilpatrick, II | G06F 1/1616 345/1.3 |
| 2010/0245106 | A1* | 9/2010 | Miller et al. | 340/686.1 |
| 2011/0199361 | A1* | 8/2011 | Shin | 345/211 |
| 2013/0077228 | A1* | 3/2013 | Batio | 361/679.29 |
| 2013/0135351 | A1* | 5/2013 | Tripathi | G06T 3/606 345/649 |
| 2013/0194394 | A1* | 8/2013 | Shintani | 348/51 |
| 2013/0215041 | A1* | 8/2013 | Kim et al. | 345/173 |
| 2015/0002998 | A1* | 1/2015 | Arima | G06F 1/1637 361/679.27 |

FOREIGN PATENT DOCUMENTS

| | | | | |
|---|---|---|---|---|
| CN | 102710823 | | 10/2012 | |
| KR | 20110137914 | | 12/2011 | |
| WO | WO2013/114820 | * | 1/2013 | G06F 1/16 |

OTHER PUBLICATIONS

First Office Action dated Dec. 25, 2015 out of Chinese priority Application No. 201210473453.7 (13 pages including English translation).

Second Office Action dated Oct. 19, 2016 (10 pages including English translation) out of Chinese priority Application No. 201210452824.3.

* cited by examiner

DISPLAY CONTROL METHOD AND ELECTRONIC DEVICE

This application claims priority to Chinese Patent Application No. 201210452824.3 filed on Nov. 13, 2012 and also to Chinese Patent Application No. 201210473453.7 filed on Nov. 20, 2012, the entire contents of which are incorporated herein by reference.

The present invention relates to a field of electronic technology, in particular to a display control method and an electronic device.

BACKGROUND

In the prior art, as opening and closing state of a notebook computer and setting of its display screen is more free, a technology of setting a plurality of display screens on one notebook computer emerges at present. Such kind of notebook can be divided into two parts, i.e., a display screen part and a keyboard part, wherein the display screen part may be set with two display units (a first display unit and a second display unit). The display unit that contacts with the keyboard when a lid of the notebook computer is closed is the first display unit, and the second display unit is set at the back of the first display unit.

There are two operating modes for the electronic device in the prior art. The first is that the notebook computer is in an operating state of Android operation system under ARM architecture after the lid of the notebook computer has been closed (as shown in FIG. 1). The second is that the notebook computer is in an operating state of Window operation system under X86 architecture after the keyboard part and the display screen part of the notebook computer are turned on (as shown in FIG. 2).

In the process of implementing technical solutions of embodiments of the present invention, inventors of the present application find that there are following technical problems in the process of running or flashing a basic input/output system in the prior art:

There is a problem under the ARM architecture (that is, the second display unit of the notebook computer performs a display operation, and the notebook computer is in a form of a panel personal computer). Due to limitation of control manner of lid closing at present, a fixed vertical display mode cannot be used under the Android operation system. If a user keeps the notebook computer in the state of the panel personal computer, it needs to make use of an arm as a supporting means in order to make it convenient for the user to view the display screen, because the notebook computer is heavier than a conventional handheld device. If the notebook computer has been in the state of the panel personal computer for a long time, the hand and arm will get tired, thus producing inconvenience for the operation and use of the user.

SUMMARY

The present invention provides a display control method and an electronic device. The method and device provided in the present invention provide a triangle supporting state of the electronic device, in which the notebook computer does not need the user to support the notebook computer with hands to operate in the mode of the Android operation system under the ARM architecture, thus reducing the burden on the user's operation in the panel personal computer mode of the notebook computer and improving the experience of the user.

The present invention provides a display control method applicable to an electronic device. The electronic device comprises a first body and a second body; the first body and the second body are connected through a shaft, such that the first body and the second body are fixed at any angle; two sides of the first body are set with a first display area and a second display area respectively; and the second body is set with a keyboard. The method comprises:

acquiring space position information of the first body and the second body, determining whether the space position information satisfies a first space predetermined condition, and obtaining a first determining result;

detecting a first included angle between the first body and the second body if the first determining result indicates that the space position information satisfies the first space predetermined condition;

determining whether the first included angle satisfies a first included angle predetermined condition, and switching an operating state of the electronic device to a triangle supporting state if the first included angle satisfies the first included angle predetermined condition, wherein the triangle supporting state is that the shaft is taken as a vertex of a triangle, the first body and the second body are taken as two sides of the triangle, and in the triangle supporting state, a display area set at outside of the triangle is taken as a target display area to perform a display operation.

In an example, acquiring the space position information of the first body and the second body comprises: detecting the space position information of the first body and/or the second body through an acceleration sensor set on the first body and/or the second body.

In an example, the target display area performing a display operation comprises: acquiring an image to be displayed; and rotating 180 degrees a coordinate of each of pixel points in the image to be displayed within a horizontal plane.

In an example, switching the operating state of the electronic device to the triangle supporting state comprises: detecting whether a current operation system of the electronic device is WINDOWS operation system, and switching the current operation system to Android operation system if it is the WINDOWS operation system.

In an example, before the operating state of the electronic device is switched to the triangle supporting state, it further comprises: determining a current display area in the system that is performing the display operation from the first display area and the second display area; detecting whether the current display area includes the target display area, and switching a display content in the current display area to the target display area according to a predetermined switching rule if the current display area does not include the target display area.

In an example, after the operating state of the electronic device is switched to the triangle supporting state, it further comprises: powering off a display area other than the target display area when the target display area is any one of the first display area and the second display area.

In an example, the method further comprises: receiving a first position detecting instruction; performing the first position detecting instruction, and detecting and obtaining a first data that indicates a first position relationship between the first body and M external operators, wherein M is an integer larger than or equal to 1; acquiring a predetermined condition corresponding to the first data based on the first data, wherein the predetermined condition comprises a position reference data between the first body and the second body; detecting a second position relationship between the first body and the second body, and obtaining a second data corresponding to the second position relationship; determining whether the second data satisfies the predetermined condition, and obtaining a second determining result; and generating a first prompt information to prompt that a display angle of the display unit is beyond a standard view angle range of at least one of the M external operators if the second determining result indicates that the second data does not satisfies the predetermined condition.

In an example, the detecting and obtaining a first data that indicates a first position relationship between the first body and the M external operators comprises: detecting a value of distance between a reference point of the display unit and a predetermined benchmark point of each of the M external operators to obtain M distance values; detecting a height difference between the reference point and the predetermined benchmark point of each of the M external operators to obtain M height differences; obtaining the first data that indicates the first position relationship between the first body and M external operators based on the M distance values and the M height differences.

In an example, the detecting a second position relationship between the first body and the second body, and the obtaining a second data corresponding to the second position relationship are: detecting a rotation angle of the shaft; and obtaining the second data corresponding to the second position relationship based on the rotation angle.

In an example, after the first prompt information is generated, the method further comprises: detecting whether there is an adjusting operation that adjusts positions of the first body and/or the second body; if there is the adjusting operating, adjusting a relative position of the first body and the second body in response to the adjusting operation, and monitoring a position change of the first body and the second body, and acquiring a third data corresponding to a real time position relationship between the first body and the second body; determining whether the third data satisfies the predetermined condition, and obtaining a third determining result; and generating a second prompt information to prompt that a display angle of the display unit is within a standard view angle range of each of the M external operators if the third determining result indicates that the third data satisfies the predetermined condition.

The present invention further provides an electronic device. The electronic device comprises a first body and a second body; the first body and the second body are connected through a shaft, such that the first body and the second body are fixed at any angle; two sides of the first body are set with a first display area and a second display area respectively; and the second body is set with a keyboard. The electronic device further comprises:

a space position determining module for acquiring space position information of the first body and the second body, determining whether the space position information satisfies a first space predetermined condition, and obtaining a first determining result;

an included angle detecting module for detecting a first included angle between the first body and the second body if the first determining result indicates that the space position information satisfies the first space predetermined condition;

an operating state switching module for determining whether the first included angle satisfies a first included angle predetermined condition, and switching an operating state of the electronic device to a triangle supporting state if the first included angle satisfies the first included angle predetermined condition, wherein the triangle supporting state is that the shaft is taken as a vertex of a triangle, the first body and the second body are taken as two sides of the triangle, and in the triangle supporting state, a display area set at outside of the triangle being is taken as a target display area to perform a display operation.

In an example, the space position determining module acquiring the space position information of the first body and the second body comprises: detecting the space position information of the first body and/or the second body through an acceleration sensor set on the first body and/or the second body.

In an example, the operating state switching module performing the display operation by the target display area comprises: acquiring an image to be displayed; and rotating 180 degrees a coordinate of each of pixel points in the image to be displayed within a horizontal plane.

In an example, the operating state switching module is further used for detecting whether a current operation system of the electronic device is WINDOWS operation system, and switching the current operation system to Android operation system if it is the WINDOWS operation system.

In an example, the operating state switching module is further used for determining a current display area in the system that is performing the display operation from the first display area and the second display area; detecting whether the current display area includes the target display area, and switching a display content in the current display area to the target display area according to a predetermined switching rule if the current display area does not include the target display area.

In an example, the electronic device further comprises: a detecting unit for detecting and obtaining a first data that indicates a first position relationship between the first body and M external operators after a first position detecting instruction is received, wherein M is an integer larger than or equal to 1, detecting a second position relationship between the first body and the second body, and obtaining a second data corresponding to the second position relationship; a data processing unit connected to the detecting unit for acquiring a predetermined condition corresponding to the first data based on the first data, wherein the predetermined condition comprises a position reference data between the first body and the second body; a determining unit connected to the detecting unit and the data processing unit for determining whether the second data satisfies the predetermined condition, and obtaining a second determining result; an information generating unit connected to the determining unit for generating a first prompt information to prompt that a display angle of the display unit is beyond a standard view angle range of at least one of the M external operators if the second determining result indicates that the second data does not satisfy the predetermined condition.

In an example, the detecting unit comprises a first detecting subunit for detecting a value of distance between a reference point of the display unit and a predetermined benchmark point of each of the M external operators to obtain M distance values; and detecting a height difference between the reference point and the predetermined benchmark point of each of the M external operators to obtain M height differences; a first data acquiring subunit connected to the first detecting subunit for obtaining the first data that indicates the first position relationship between the first body and the M external operators based on the M distance values and the M height differences.

In an example, the detecting unit further comprises a second detecting subunit for detecting a rotation angle of the shaft; and a second data acquiring subunit connected to the second detecting subunit for obtaining the second data corresponding to the second position relationship based on the rotation angle.

In an example, the electronic device further comprises a monitoring unit connected to the detecting unit, the determining unit and the information generating unit for monitoring a position change of the first body and the second body and acquiring a third data corresponding to a real time position relationship between the first body and the second body when the detecting unit detects that there is an adjusting operation that adjusts positions of the first body and the second body, so that the information generating unit generates a second prompt information to prompt that a display angle of the display unit is within a standard view angle range of each of the M external operators when the determining unit determines that the third data satisfies the predetermined condition.

In an example, the electronic device further comprises: an adjusting unit connected to the detecting unit and the determining unit for adjusting a relative position of the first body and the second body in response to a position adjusting operation.

One or two of the above technical solutions make at least the following technical effects:

The embodiments of the present invention provide a display control method and an electronic device. The display control method is applicable to an electronic device. The electronic device comprises a first body and a second body; the first body and the second body are connected through a shaft, such that the first body and the second body are fixed at any angle; two sides of the first body are set with a first display area and a second display area respectively; and the second body is set with a keyboard. The method comprises: acquiring space position information of the first body and the second body, determining whether the space position information satisfies a first space predetermined condition, and obtaining a first determining result; detecting a first included angle between the first body and the second body if the first determining result indicates that the space position information satisfies the first space predetermined condition; determining whether the first included angle satisfies a first included angle predetermined condition, and switching an operating state of the electronic device to a triangle supporting state if the first included angle satisfies the first included angle predetermined condition, wherein the triangle supporting state is that the shaft is taken as a vertex of a triangle, the first body and the second body are taken as two sides of the triangle, and in the triangle supporting state, a display area set at outside of the triangle is taken as a target display area to perform a display operation. Therefore, the method provided in the present invention can detect whether the screen part and the keyboard part of the notebook computer form a triangle supporting state, and if they form the triangle supporting state, the current display content is switched to the display unit at the outside of the triangle to be displayed, because in the triangle supporting state, the notebook computer can be placed on any plane, and the notebook computer does not need the user to support the notebook with hands to operate in the Android mode under the ARM architecture, thus reducing the burden on the user's operation in the panel personal computer mode of the notebook computer and improving the experience of the user. As a result, the usable state of the electronic device is increased, thus enhancing applicability of the electronic device.

DETAILED DESCRIPTION

The embodiments of the present invention provide a display control method applicable to an electronic device. The electronic device comprises a first body and a second body; the first body and the second body are connected through a shaft, such that the first body and the second body are fixed at any angle; two sides of the first body are set with a first display area and a second display area respectively; and the second body is set with a keyboard. The method comprises: acquiring space position information of the first body and the second body, determining whether the space position information satisfies a first space predetermined condition, and obtaining a first determining result; detecting a first included angle between the first body and the second body if the first determining result indicates that the space position information satisfies the first space predetermined condition; determining whether the first included angle satisfies a first included angle predetermined condition, and switching an operating state of the electronic device to a triangle supporting state if the first included angle satisfies the first included angle predetermined condition, wherein the triangle supporting state is that the shaft is taken as a vertex of a triangle, the first body and the second body are taken as two sides of the triangle, and in the triangle supporting state, a display area set at outside of the triangle is taken as a target display area to perform a display operation.

Figure 3:
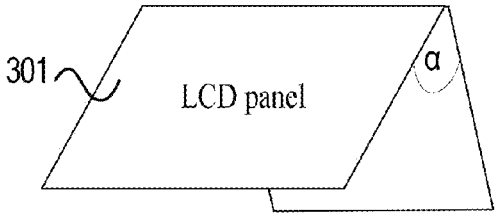
FIG. 3 is an illustrative diagram of a structure of an electronic device when the electronic device is in a triangle supporting state in an embodiment of the present invention.

In the prior art, under the ARM architecture, due to limitation of control manner of lid closing at present, a fixed vertical display mode cannot be used in the Android operation system. If the user keeps the notebook computer in the state of the panel personal computer, it needs to make use of an arm as a supporting means in order to make it convenient for the user to view the display screen, because the notebook computer is heavier than a conventional handheld device. If the notebook computer has been in the state of the panel personal computer for a long time, the hand and arm will get tired, thus producing inconvenience for the operation and use of the user. Therefore, the method provided in the present invention can detect whether the screen part and the keyboard part of the notebook computer form the triangle supporting state (as shown in FIG. 3, the two parts of the notebook computer are tent-shaped), and if they form the triangle supporting state, the current display content is switched to the display unit (display unit 301) at the outside of the triangle to be displayed, because in the triangle supporting state, the notebook computer can be placed on any plane, and the notebook does not need the user to support the notebook with hands to operate in the Android operation system mode under the ARM architecture, thus reducing the burden on the user's operation in the panel personal computer mode of the notebook computer and improving the experience of the user. As a result, the usable state of the electronic device is increased, thus enhancing applicability of the electronic device. Below is a further detailed specification of the method provided in the embodiment of the specification in combination with the accompanying drawings of the specification.

Figure 4:
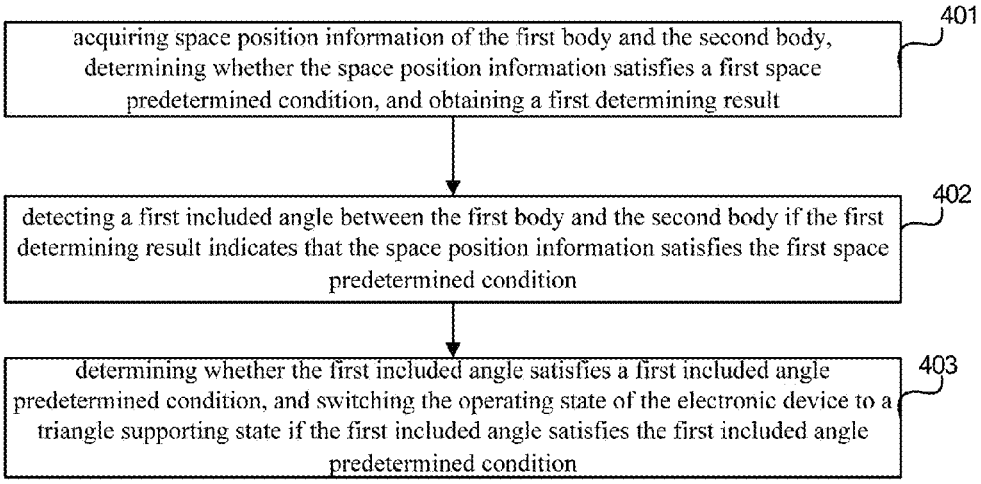
FIG. 4 is an illustrative diagram of a flow of a display control method in an embodiment of the present invention.

As shown in FIG. 4, the embodiment of the present invention provides a display control method. Below is a detailed specification of the specific implementations of the present invention in combination with the accompanying drawing of the specification.

Figure 1:
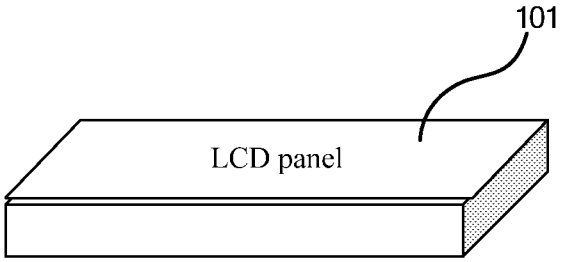
Fig.1 (Prior Art)
FIG. 1 is an illustrative diagram of a structure of an electronic device when the electronic device is in a panel personal computer state in the prior art.
Figure 2:
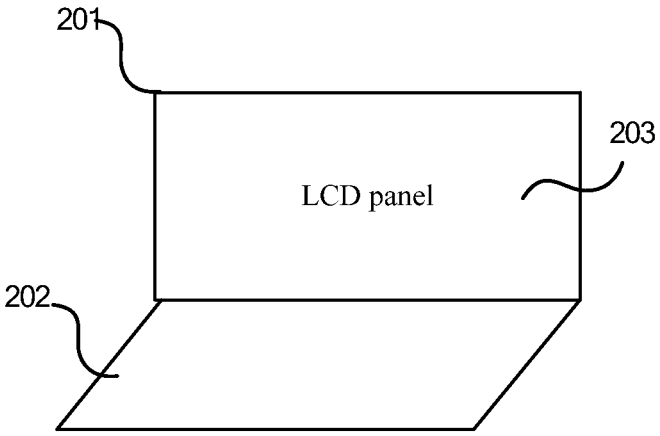
Fig.2 (Prior Art)
FIG. 2 is an illustrative diagram of a structure of an electronic device when the electronic device is in a notebook computer state in the prior art.

The method provided in the embodiment of the present invention is applicable to an electronic device. In the prior art, the electronic device comprises a panel personal computer state (or called as a first state) as shown in FIG. 1 and a notebook computer state (or called as a second state) as shown in FIG. 2. The electronic device comprises a first body (201 in FIG. 2) and a second body (202 in FIG. 2), the first body and the second body are connected through a shaft, such that the first body and the second body are fixed at any angle; two sides of the first body are set with a first display area and a second display area respectively (in the present embodiment, the first display area is 101 in FIG. 1; and the second display area is 203 in FIG. 2); and the second body is set with a keyboard. The display control method provided in the embodiment of the present invention in particular comprises steps 401-403 as shown in FIG. 4.

At step 401, space position information of the first body and the second body is acquired, and it is determined whether the space position information satisfies a first space predetermined condition to obtain a first determining result.

In the present embodiment, the acquiring of space position information of the first body and the second body can be implemented by a specific manner as follows:

detecting the space position information of the first body and/or the second body through an acceleration sensor set on the first body and/or the second body.

In the present embodiment, a three-dimensional acceleration sensor may be selected and used. The three-dimensional acceleration sensor can detect three-dimensional space positions of the first body, the second body and the shaft, thus obtaining space position information of respective parts of the electronic device.

Acceleration is a space vector. On one hand, in order to accurately know a state of motion of an object, motion components at the three coordinate axes of the object must be detected; on the other hand, in an occasion of not knowing a direction of motion of the object in advance, the three-dimensional acceleration sensor can only be applied to detect an acceleration signal.

Figure 5:
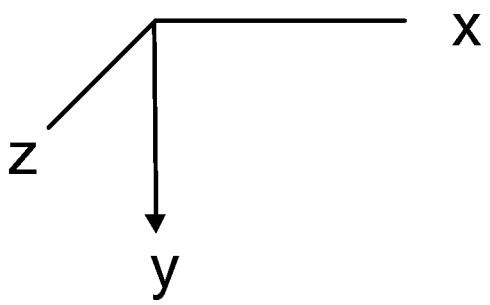
Fig.5 (Prior Art)
FIG. 5 is an illustrative diagram of a space direction of gravity when an operating state of the electronic device is a first state or a second state in the prior art.
Figure 6:
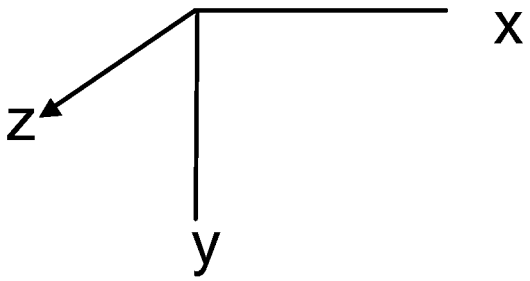
FIG. 6 is an illustrative diagram of a space direction of gravity when an operating state of the electronic device is the triangle supporting state in an embodiment of the present invention.

In the present embodiment, if the sensor is set in the second body, the coordinate of the three directions of the three-dimensional acceleration sensor is an initial coordinate when the electronic device is in a state as shown in FIG. 1 or 2 (as shown in FIG. 5). In this initial coordinate, a direction of gravity is the negative direction of y axis. In the present embodiment, if the electronic device is switched to the triangle supporting state, the direction of gravity will make a change relative to the coordinate in FIG. 5 (as shown in FIG. 6, in the triangle supporting state, the direction of gravity will be changed into the positive direction of z axis).

In the implementation, it can be set that, the first predetermined condition is that the direction of gravity detected by the three-dimensional acceleration sensor is the positive direction of z axis as shown in FIG. 5. Therefore, when the direction of gravity detected by the three-dimensional acceleration sensor is consistent with the positive direction of z axis, it is determined that the detected space position information satisfies the first predetermined condition.

At step 402, a first included angle between the first body and the second body is detected if the first determining result indicates that the space position information satisfies the first space predetermined condition.

In the present embodiment, if the electronic device is in the triangle supporting state, besides detecting the change in the space positions of the respective components and parts of the electronic device at step 401, it further needs to detect whether the included angle formed between the first body (or called as the display screen part) and the second body (or called as the keyboard part) satisfies a certain requirement. Therefore, the present embodiment further needs to detect the included angle (the included angle $\alpha$ as shown in FIG. 3) between the first body and the second body through an angle detecting device.

At step 403, it is determined whether the first included angle satisfies a first included angle predetermined condition, and if it satisfies the first included angle predetermined condition, the operating state of the electronic device is switched to the triangle supporting state, wherein the triangle supporting state is that the shaft is taken as a vertex of a triangle, the first body and the second body are taken as two sides of the triangle, and in the triangle supporting state, a display area set at outside of the triangle is taken as a target display area to perform a display operation.

In the prior art, when the electronic device is switched between the first state and the second state, the display coordinate system adopted by the display unit does not need to be adjusted; however, in the present solution, since the electronic device has been switched to the triangle supporting state, relative to the original display coordinate system, it is needed to adjust the original display coordinate system or the coordinate system corresponding to the display image when the display unit needs to display an image meeting with the user's requirements for viewing. In the present embodiment, if the coordinate of the display content is adjusted, the target display area performing the display operation comprises:

acquiring an image to be displayed; and rotating 180 degrees a coordinate of each of pixel points in the image to be displayed within a horizontal plane.

In addition, if the display coordinate system is adjusted, it needs to rotate 180 degrees the coordinate system within the horizontal plane.

Since the method of the embodiment of the present invention provides the triangle supporting state being different from the first state and the second state, the embodiment of the present invention further provides a specific implementation of mutually switching between the first state and the triangle supporting state and mutually switching between the second state and the triangle supporting state.

(1) Switching from the first state to the triangle supporting state, with a specific implementation as follows:

In the first state, the display area performing the display operation is the display area of the two display areas being set at the outside of the electronic device, and thus the target display area is the same as the display area in the triangle supporting state. Therefore, the first state differs from the triangle supporting state merely in: the display area of the electronic device is not inclinedly placed with certain angle of inclination through physically supporting in the first state, and the up and down order of the display content in the first state is inversed to that in the triangle supporting state. Therefore, switching from the first state to the triangle supporting state just needs to adjust the display coordinate of the display content within the display area in the first state.

(2) Switching from the second state to the triangle supporting state, with a specific implementation as follows:

When switching the operating state is performed, the implementation of switching the display content can be as follows:

determining a current display area in the system that is performing the display operation from the first display area and the second display area; and detecting whether the current display area includes the target display area, and if it does not include the target display area, a display content in the current display area is switched to the target display area according to a predetermined switching rule.

In a specific application environment, since the target display area in the second state may be the first display area and/or the second display area, the specific switching depending on different display areas comprises:

A. In a case of the second display area being the target display area, when a switch is performed, it particularly comprises:

After the electronic device is switched to the triangle supporting state, the second display area belongs to an invisible area, and cannot to achieve the purpose of displaying, and thus the target display area is the first display area. As a result, according to the condition of the triangle supporting state, when it is switched from the second state to the triangle supporting state, it needs to switch the content originally transmitted to the second display area to be displayed to the first display area to be displayed.

In addition, since the second state is the operating state in the WINDOWS operation system under the X86 architecture, the applications required for the operating mode of the electronic device when the electronic device is switched from the second state to the triangle supporting state are the same as those when the electronic device is switched from the first state to the triangle supporting state the first state. Moreover, it is needed to switch the operation system in this embodiment, with a specific implementation as follows:

detecting whether the current operation system of the electronic device is the operating state in the WINDOWS operation system, and if it is the operating state in the WINDOWS operation system, the operating state is switched to the operating state in the Android operation system.

B. In a case of the first display area being the target display area, when a switch is performed, it particularly comprises:

In this mode, the target display area selected in both the second state and the triangle supporting state are the same, and thus performing a switch in the states needs to adjust the operation system of the electronic device and the display coordinate of the display content.

C. In a case of both the first display area and the second display area being the target display area, when a switch is performed, it particularly comprises:

The solution C further comprises two cases. The display contents in the first display area and the second display area may either be same or different. When the display contents in the first display area and the second display area are the same, the switch is performed according to solution B. When the display contents in the first display area and the second display area are different, before performing the switch, the solution C further comprises: receiving selection instruction for the target display content input by the user, and determining the content needed to be displayed after the user performs the operation of switching.

The switch is performed according to solution B if the user selects the display content in the first display area; the switch is performed according to solution A if the user selects the content in the second display area.

In order to achieve the effect of reducing power consumption of the electronic device, in this embodiment, since the second display area is invisible from the user, after the operating state of the electronic device is switched to the triangle supporting state, it further comprises: powering off another display area other than the target display area.

In the embodiment of the present invention, at step 402, the specific implementation that the first included angle between the first body and the second body is detected comprises:

(1) the first included angle between the first body and the second body is determined through the sensor of gemel/shaft portion between the first body and the second body; and it is determined that a folding operation occurs to the first body and the second body of the electronic device when a degree of the first included angle is larger or smaller than certain threshold. In a specific implementation, different thresholds are set depending on different detection angles. If the included angle between the back of the first body and the second body is detected, the folding operation occurs when the degree of the included angle is smaller than a threshold; if the included angle between the face of the first body and the second body is detected, the folding operation occurs when the degree of the included angle is larger than the threshold.

(2) A sensor is set at the face or back of the first body and the second body. It is determined that the fold operation occurs if data detected by the sensor satisfies the predetermined condition, wherein the sensor may be selected as a distance sensor. If the distance sensor is set at the back of the display unit, it is determined that the folding operation occurs when the distance sensor detects that the distance from the first body to the second body is less than the threshold.

In addition, in the process of implementing the technical solutions of the embodiment of the present invention, the inventors of the present application finds that the following technical problems exist in the prior art: when the user is diagonally opposite to the display screen, his/her eyes will feel very uncomfortable. In this case, it is always needed to adjust the display screen to a position opposite to the eyes.

When the display angle of the display screen is adjusted, it merely depends on the individual sense and viewing habit of the user to particularly adjust the display angle. However, the individual sense and viewing habit of the user are always incorrect, and thus there is a deviation between the display angle and the correct viewing angle. In particular, when a plurality of users share one display screen and one of the users adjusts the display angle of the display unit, the adjusted angle may be inappropriate for other users because the electronic device cannot prompt whether the current display angle of the display unit adjusted by the user is appropriate for view angles of other users. As a result, there is a technical problem of inaccurate display angle.

Therefore, in the technical solutions provided in the embodiment of the present application, the display control method may further comprise: determining whether the display angle of the display unit is within a standard view angle range of the M external operators by detecting the first position relationship between the first body set with the display unit and the M external operators and the second position relationship between the second body connected to the first body and the first body; and prompting to adjust the display angle if the display angle is beyond the standard view angle range. In this way, the technical problem of an inaccurate display angle in the prior art is solved, so that the display angle of the display unit is within the standard view angle so as to enhance the accuracy of the display angle.

Figure 7:
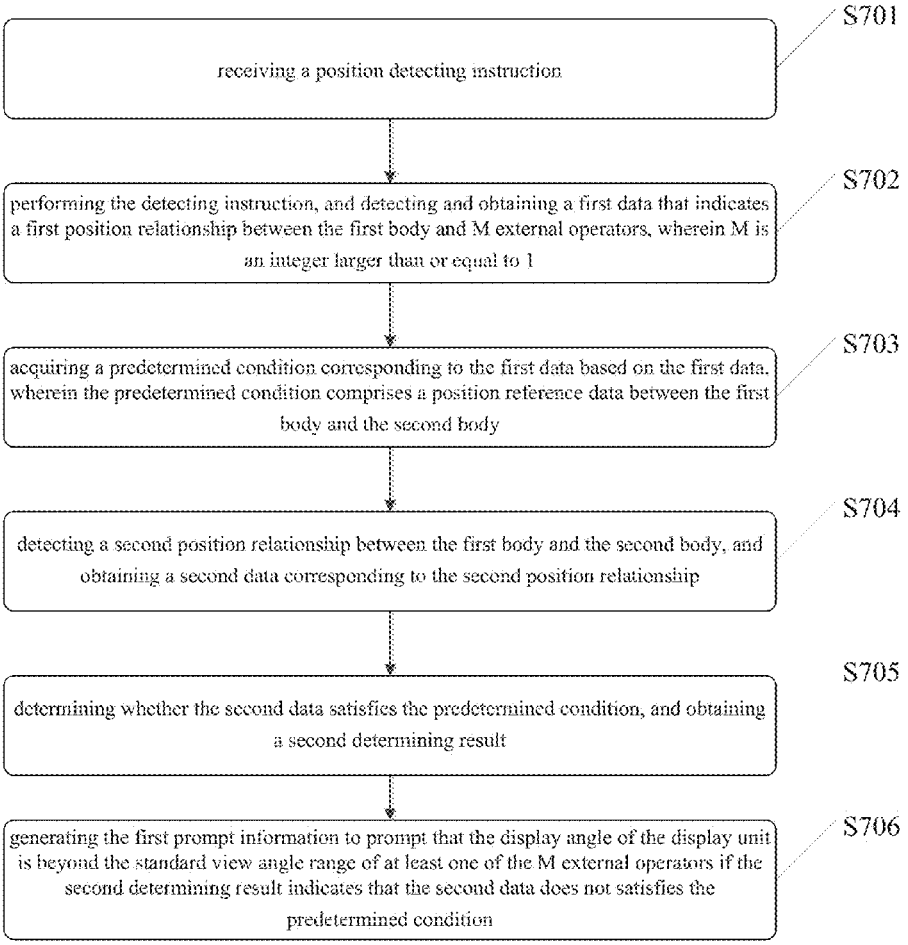
FIG. 7 is an illustrative diagram of a flow of a method for prompting an angle adjustment in an embodiment of the present invention.

Below will be a detailed description of major realization principles, specific implementations and correspondingly achieved beneficial effects of an angle adjustment in the embodiment of the present application in combination with the accompanying drawings Referring to FIG. 7, the method for prompting the angle adjustment in the embodiment of the present application comprises the following steps.

At S701, a position detecting instruction is received.

The detecting instruction may be given when the electronic device is powered on or may be given by the electronic device at a certain time period, or may be triggered after the user pushes down the position detecting key on the electronic device according to actual needs. In order to increase flexibility of time for detection, the specific detection time can be voluntarily set by the user according to his/her individual actual conditions.

At S702, the detecting instruction is performed, and a first data that indicates a first position relationship between the first body and M external operators is detected and obtained, wherein M is an integer larger than or equal to 1.

In particular, M may be 1, that is, the situation when one user uses the electronic device; M may be 2, for example, the situation when the user invites a friend to watch a film; of course, M may be 3 or more than 3, for example, a plurality of persons discuss a case. Therefore, M can be set by the user according to the specific situations, and is not limited to one specific number.

At S703, a predetermined condition corresponding to the first data based on the first data is acquired, wherein the predetermined condition comprises a position reference data between the first body and the second body. The predetermined condition is in particular as follows: a range of a reference angle degree of the first body relative to the second body, so that the display angle of the display unit on the first body is appropriate for the view angles of all M external operators.

At S704, a second position relationship between the first body and the second body is detected, and a second data corresponding to the second position relationship is obtained. The first body of the electronic device is connected to the second body via the shaft, and the first body can be rotated relative to the second body through the shaft, and thus the display unit of the first body can be adjusted to the standard view angle ranges of the M external operators through adjusting the position of the first body relative to the second body. As a result, it is needed to firstly detect the second position relationship between the first body and the second body.

At S705, it is determined whether the second data satisfies the predetermined condition, and a second determining result is obtained.

In particular, the second determining result has two cases: (1) the second data satisfies the predetermined condition, which indicates that the display angle of the display unit is within the standard view angle ranges of the M external operators. At this time, it is not needed to make any adjustment to the first body; (2) the second data does not satisfy the predetermined condition, which indicates that the display angle of the display unit is beyond the standard view angle range of each of the M external operators. At this time, it continues to perform the next step.

At S706, the first prompt information is generated to prompt that the display angle of the display unit is beyond the standard view angle range of at least one of the M external operators if the second determining result indicates that the second data does not satisfies the predetermined condition.

The first prompt information may be voice prompt information, or may be indicator light prompt information, or may be dialog box prompt information popped up on the electronic device. There are diversifies of prompt information forms, detailed omitted, In the specific implementation, the detecting and obtaining of the first data that indicates the first position relationship between the first body and the M external operators particularly comprises:

First, detecting the value of distance between the display unit and each of the M external operators to obtain M distance values; next, detecting the height difference between the reference point of the display unit and the predetermined benchmark point of each of the M external operators to obtain M height differences; then, obtaining the first data that indicate the first position relationship between the first body and the M external operators based on the M distance values and the M height differences.

Figure 8:
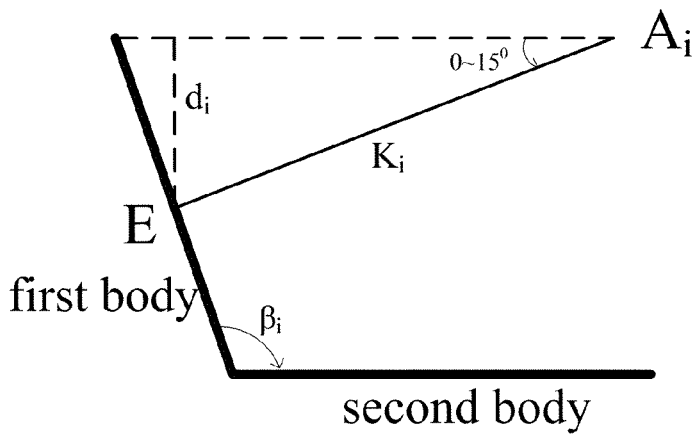
FIG. 8 is an illustrative diagram of position relationship between an $i^{th}$ operator and the electronic device in an embodiment of the present invention.

In order to know whether the display angle of the display unit on the electronic device is within the standard view angle range of the users (i.e., the operators), it is needed to firstly determine the position of the M external operators relative to the display unit. In particular, the value $k_i$ of distance between the reference point of the display unit and the predetermined benchmark point of each of the M external operators can be detected via infrared distance measuring, wherein i is an integer and $1 \leq i \leq M$. Then, the height difference $d_i$ between the reference point of the display unit and the predetermined benchmark point of each of the M external operators, wherein the reference point of the display unit may be the central point, the midpoint of top edge or the edge point of the lower right corner of the display unit. In order to make it convenient for calculation and detection, a central point E as shown in FIG. 8 is generally selected as the reference point. Meanwhile, based on principles of simplicity, convenience and accuracy, the predetermined benchmark point may be selected the midpoint $A_i$ of the eyes of the user, but not limited to the midpoint $A_i$ of the eyes. Last, the first data that indicated the first position relationship between the first body and the M external operators is obtained based on the M distance values and the M height differences.

After the first data is obtained, the predetermined condition corresponding to the first data is acquired. Since the optimal line of sight is the horizontal line of sight when human eyes are watching things, such requirement always cannot be reached due to the restriction of the real-world scene. However, if the included angle between the line of sight and the horizontal line exceeds 15 degrees when human eyes are watching things, the vision will be too blurred to clearly differentiate the specific form or change of objects, and at the same time, it is very easy to cause visual fatigue, which brings great damage to the eyes. Therefore, the predetermined condition corresponding to the first data, i.e., the range of the included angle that should be maintained between the first body and the second body, is obtained depending on the standard view angle range, i.e., 0-15 degrees, as well as the position relationship between the operator, the first body and the second body. In particular, referring to FIG. 2, the value of distance between the predetermined benchmark point $A_i$ of one operator of the M external operators (i.e., one user) and the central point E of the display unit on the first body is $k_i$, and the height difference between the central point E and the redetermined benchmark point $A_i$ is $d_i$, then the range of the included angle between the first body and the second body can be obtained as the range of $\beta_i$ according to the formula $\beta_i \approx \pi - \arcsin(d_i/k_i \cdot \sin \alpha)$, wherein the numeric range of a is 0-15 degrees. Then, intersection of all values of $\beta_i$ is calculated so as to obtain the predetermined condition of the first data, for example, M=2, the detected and obtained $\beta_1 \epsilon (90°, 105°)$ and $\beta_2 \epsilon (98°, 113°)$, then the predetermined condition is that the included angle falls into the range of 98-105 degrees.

After the corresponding predetermined condition is obtained, the second position relationship between the first body and the second body is detected, and the second data corresponding to the second position relationship is obtained. In particular, the rotation angle of the shaft can be detected through the angle sensor installed on the shaft, and the second data corresponding to the second position relationship is obtained based on the rotation angle, i.e., the degree of the included angle between the first body and the second body. If the second data does not satisfies the predetermined condition, the user is prompted that the current position is inappropriate for the view angles of all users, which will thus urge the user to adjust the display angle of the display unit so as to satisfy the view angles of all users.

In the specific implementation process, in order to make the user to adjust the display angle quicker and more accurate, the first prompt information not only includes the content prompting the user that the display angle of the display unit is beyond the standard view angle range of at least one of the M external operators but also includes the content guiding the user how to adjust the position of the first body, for example, rotating downward 15 degrees or upward 20 degrees and so on. In the meantime, the embodiment of the present application further provides the following methods after the first prompt information is generated:

detecting whether there is an adjusting operation that adjusts positions of the first body and/or the second body; if there is the adjusting operating, monitoring a position change of the first body and the second body, and acquiring a third data corresponding to a real time position relationship between the first body and the second body; determining whether the third data satisfies the predetermined condition, and obtaining a third determining result; and generating a second prompt information to prompt that a display angle of the display unit is within a standard view angle range of each of the M external operators if the third determining result indicates that the third data satisfies the predetermined condition.

The user is prompted through the second prompt information, i.e., voice prompt information, indicator light prompt information, or dialog box prompt information, that the appropriate position has been reached, thus preventing the user from wasting time on adjusting the display angle again and again and improving the efficiency for adjusting the angle. Further, in order to increase intelligence of the electronic device, the present application further can adjust the relative position between the first body and the second body in response to the position adjusting operation after the first prompt information is generated, that is, when the user pushes down the angle adjustment button on the electronic device, the electronic device can automatically adjust the angle between the first body and the second body, so that the display angle of the display unit is within the standard view angle ranges of the M external operators.

Figure 9:
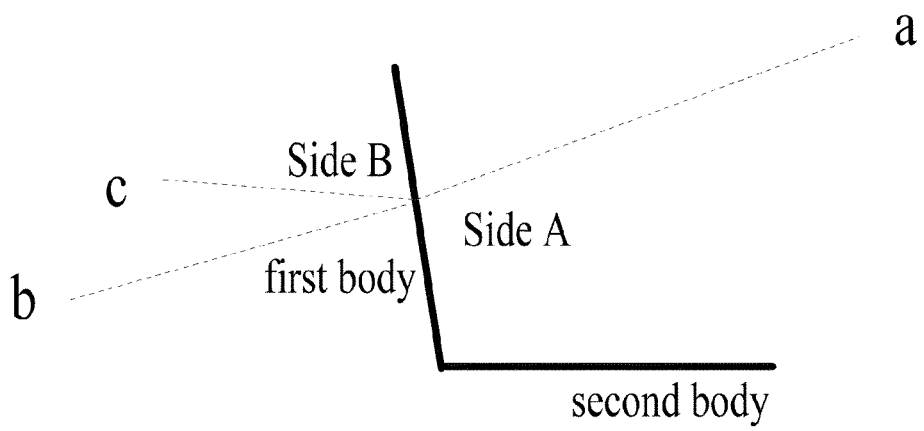
FIG. 9 is an illustrative diagram of position relationship among M operators and the electronic device in an embodiment of the present invention.

In the specific implementation process, the first body is in particular a body having a single screen display or a double-screen display, that is, the first body is set with one display screen or two display screens, for example, the first body is set with one display screen when the electronic device is a TV set or a single screen computer; and the first body is set with two display screens when the electronic device is a double-screen notebook computer. Referring to FIG. 9, as for the electronic device with two display screens, one display screen is set at side A of the first body and the other display screen is set at side B back to the side A of the first body. The user at side A and the user at side B are sheltered from each other by the first body. In the prior art, when the user at side A or the user at side B adjusts the display screen, he/she can just adjust the display screen while asking the opposite user whether the angle is appropriate because the user himself/herself cannot know whether the opposite display angle is appropriate for the opposite user, that is, it is needed that the users at two sides of the first body to jointly coordinate with each other to complete the adjustment of the display angle. However, the method provided in the present application enables to adjust by only the user at side A or side B the position of the first body according to the first prompt information and the second prompt information, such that the users at both side A and side B are able to have appropriate view angles without a joint coordination of the users at both side A and side B, which is convenient, fast and humanized.

For example, there are three users of a, b, c using the electronic device at the same time, i.e., M=3, wherein the user a uses the display screen at side A, the users b and c use the display screen at side B. The detected and obtained $\beta_1$, $\beta_2$, $\beta_3$ corresponding to the users a, b, c are $\beta_1 \epsilon (85°, 100°)$, $\beta_2 \epsilon (96°, 111°)$, $\beta_3 \epsilon (90°, 105°)$ respectively, and then the obtained corresponding predetermined condition is that the angle is between 96-100 degrees. After a further detection, the angle between the first body and the second body is 110 degrees, from which it is determined that 110 degrees does not satisfy with the predetermined condition of the range 96-100 degrees, so that a dialog box is popped up to prompt the user a to adjust the position of the first body and a tick voice is given to prompt the user that the display screen has been adjusted to the appropriate position when the angle is adjusted to and within the range of 96-100 degrees.

It is determined whether the current display angle of the display unit is within the standard view angle ranges of the operator through obtaining the standard display range corresponding to the standard view angle ranges of the M external operators at the current position. If the current display angle of the display unit is beyond the standard display range, the user is prompted that the display angle of the display unit is beyond the standard view angle range of each of operators, so as to urge the user or the electronic device to adjust the display angle to and within the standard display range, which solved the technical problem of inaccurate display angle in the prior art, thus increasing the display effect. At the same time, the present application monitors whether the display angle is appropriate when the user adjusts the display angle of the display unit, and prompts the user that the current display angle has been within the standard view angle ranges of the M external operators when the display angle is adjusted to and within the common standard view angle range of the M external operators, thus avoiding from adjusting to an incorrect display angle or wasting time on adjusting the display angle of the display unit again and again, improving the efficiency for adjusting the display angle and enhancing customer experience.

Figure 10:
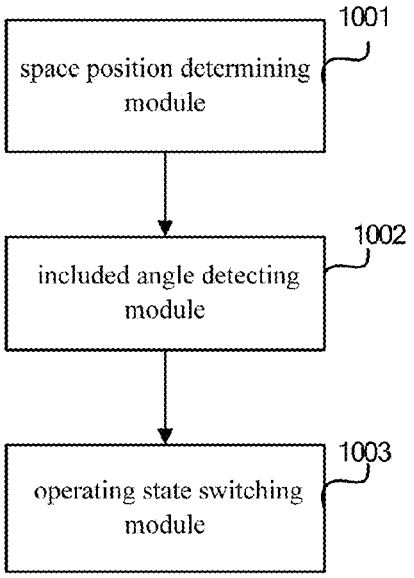
FIG. 10 is an illustrative diagram of a structure of an electronic device in an embodiment of the present invention.

As shown in FIG. 10, the embodiment of the present invention further provides an electronic device. The electronic device comprises a first body and a second body; the first body and the second body are connected through a shaft, such that the first body and the second body are fixed at any angle; two sides of the first body are set with a first display area and a second display area respectively; and the second body is set with a keyboard. The electronic device further comprises:

a space position determining module 1001 for acquiring space position information of the first body and the second body, determining whether the space position information satisfies a first space predetermined condition, and obtaining a first determining result;

an included angle detecting module 1002 for detecting a first included angle between the first body and the second body if the first determining result indicates that the space position information satisfies the first space predetermined condition;

an operating state switching module 1003 for determining whether the first included angle satisfies a first included angle predetermined condition, and switching an operating state of the electronic device to a triangle supporting state if the first included angle satisfies the first included angle predetermined condition, wherein the triangle supporting state is that the shaft is taken as a vertex of a triangle, the first body and the second body are taken as two sides of the triangle, and in the triangle supporting state, a display area set at outside of the triangle is taken as a target display area to perform a display operation.

In this embodiment, the space position determining module acquiring the space position information of the first body and the second body comprises:

detecting the space position information of the first body and/or the second body through an acceleration sensor set on the first body and/or the second body.

In this embodiment, a three dimensional acceleration sensor can be selected and used. The three dimensional acceleration sensor is able to detect the three dimensional space positions of the first body, the second body and the shaft, thus obtaining the space position information of respective parts of the electronic device.

In this embodiment, if the sensor is set in the second body, the coordinate of the three directions of the three-dimensional acceleration sensor is an initial coordinate when the electronic device is in a state as shown in FIG. 1 or 2 (as shown in FIG. 5). In this initial coordinate, a direction of gravity is the negative direction of y axis. In the present embodiment, if the electronic device is switched to the triangle supporting state, the direction of gravity will make a change relative to the coordinate in FIG. 5 (as shown in FIG. 6, in the triangle supporting state, the direction of gravity will be changed into the positive direction of z axis).

In the embodiment of the present invention, when switching the operating state is performed, the operating state switching module 1003 needs to switch display content, display coordinate, operation system and so on, particularly comprising the following two cases:

(1) switching from the first state to the triangle supporting state

The operating state switching module performing the display operation by use of the target display area comprises:

acquiring an image to be displayed; and rotating 180 degrees a coordinate of each of pixel points in the image to be displayed within a horizontal plane.

(2) switching from the second state to the triangle supporting state

Since the second state is the operating state in the WINDOWS operation system under the X86 architecture, the applications required for the operating mode of the electronic device when the electronic device is switched from the second state to the triangle supporting state are the same as those when the electronic device is switched from the first state to the triangle supporting state. Moreover, it is needed to switch the operation system in this embodiment. Therefore, the operating state switching module 1003 is further used for detecting whether a present operation system of the electronic device is the WINDOWS operation system, switching the current operation system to the Android operation system if the current operation system is the WINDOWS operation system.

In addition, the state of the electronic device is switched to the triangle supporting state when both the first display area and the second display area perform the display operation, because the display contents in the first display area and the second display area may be same or may also different. Therefore, the electronic device provided in the embodiment of the present invention further comprises the following cases:

The operating state switching module 1003 is further used for determining the current display area in the system that is performing the display operation from the first display area and the second display area; detecting whether the current display area includes the target display area, and switching the display content in the current display area to the target display area according to a predetermined switching rule if the current display area does not include the target display area.

Figure 11:
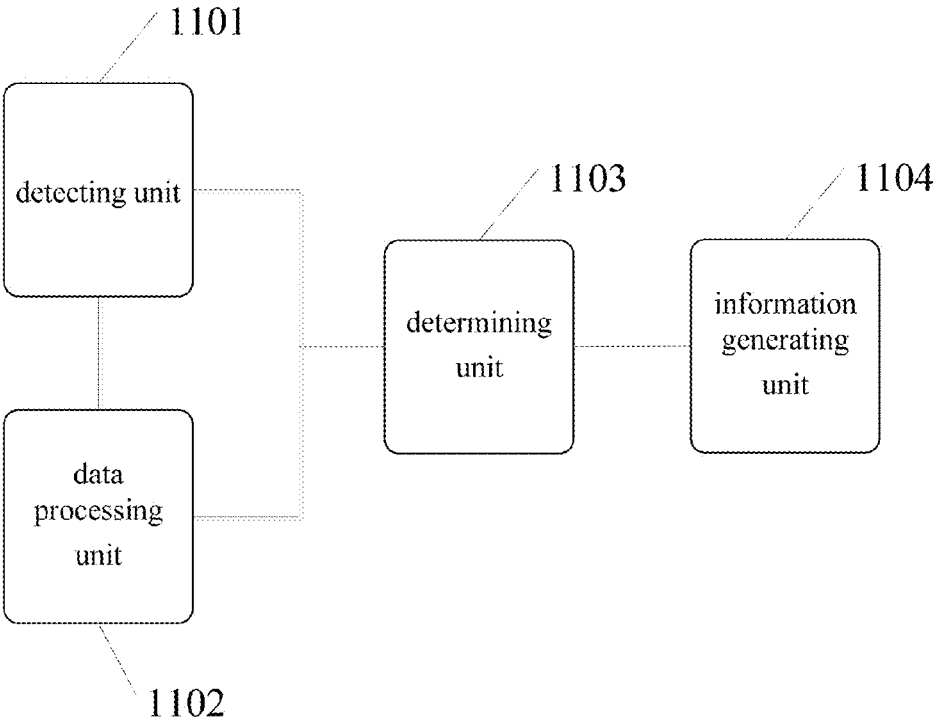
FIG. 11 is an illustrative diagram of another structure of an electronic device in an embodiment of the present invention.

In addition, referring to FIG. 11, the electronic device in the embodiment of the present application further comprises:

a detecting unit 1101 for detecting and obtaining a first data that indicates a first position relationship between the first body and M external operators after a first position detecting instruction is received, wherein M is an integer larger than or equal to 1, detecting a second position relationship between the first body and the second body, and obtaining the second data corresponding to the second position relationship;

a data processing unit 112 connected to the detecting unit 1101 for acquiring a predetermined condition corresponding to the first data based on the first data, wherein the predetermined condition comprises a position reference data between the first body and the second body;

a determining unit 1103 connected to the detecting unit 1101 and the data processing unit 1102 for determining whether the second data satisfies the predetermined condition, and obtaining a second determining result; and an information generating unit 1104 connected to the determining unit 1103 for generating a first prompt information to prompt that a display angle of the display unit is beyond a standard view angle range of at least one of the M external operators if the second determining result indicates that the second data does not satisfies the predetermined condition.

In particular, the detecting unit 1101 comprises a first detecting subunit for detecting a value of distance between a reference point of the display unit and a predetermined benchmark point of each of the M external operators to obtain M distance values; and detecting a height difference between the reference point of the display unit and the predetermined benchmark point of each of the M external operators to obtain M height differences; a first data acquiring subunit connected to the first detecting subunit for obtaining the first data that indicates the first position relationship between the first body and M external operators based on the M distance values and M height differences; a second detecting subunit for detecting a rotation angle of the shaft; and a second data acquiring subunit connected to the second detecting subunit for obtaining the second data corresponding to the second position relationship based on the rotation angle.

In order to further improve the efficiency for adjusting the display angle of the display unit. The electronic device provided in the embodiment of the present invention further comprises a monitoring unit and/or adjusting unit.

In a specific implementation process, the monitoring unit is connected to the detecting unit 1101, the determining unit 1103 and the information generating unit 1104 for monitoring a position change of the first body and the second body and acquiring a third data corresponding to a real time position relationship between the first body and the second body when the detecting unit detects that there is an adjusting operation that adjusts positions of the first body and/or the second body, so that the information generating unit generates a second prompt information to prompt that a display angle of the display unit is within the standard view angle ranges of the M external operators when the determining unit determines that the third data satisfies the predetermined condition. In the meantime, when the electronic device needs to automatically adjust the display angle, the adjusting unit can be started up. The adjusting unit is connected to the detecting unit and the determining unit for adjusting a relative position of the first body and the second body in response to a position adjusting operation, so that the display angle of the display unit is within the standard view angle ranges of the M external operators.

The above one or more technical solutions in the embodiments of the present application make at least the following technical effects:

The present invention provides a display control method and an electronic device. The display control method is applicable to an electronic device. The electronic device comprises a first body and a second body; the first body and the second body are connected through a shaft, such that the first body and the second body are fixed at any angle; two sides of the first body are set with a first display area and a second display area respectively; and the second body is set with a keyboard. The method comprises: acquiring space position information of the first body and the second body, determining whether the space position information satisfies a first space predetermined condition, and obtaining a first determining result; detecting a first included angle between the first body and the second body if the first determining result indicates that the space position information satisfies the first space predetermined condition; determining whether the first included angle satisfies a first included angle predetermined condition, and switching an operating state of the electronic device to a triangle supporting state if the first included angle satisfies the first included angle predetermined condition, wherein the triangle supporting state is that the shaft is taken as a vertex of a triangle, the first body and the second body are taken as two sides of the triangle, and in the triangle supporting state, a display area set at outside of the triangle is taken as a target display area to perform a display operation. Therefore, the method provided in the present invention can detect whether the screen part and the keyboard part of the notebook computer form the triangle supporting state, and if they form the triangle supporting state, then the present display content is switched to the display unit at the outside of the triangle to be displayed, because in the triangle supporting state, the notebook computer can be placed on any plane, and the notebook computer does not need the user to support the notebook computer with hands to operate in the Android operation system under the ARM architecture, thus reducing the burden on the user's operation in the panel personal computer mode of the notebook computer and improving the experience of the user. As a result, the usable state of the electronic state is increased, thus enhancing applicability of the electronic device.

In addition, after the method provided in the present invention is switched to the triangle supporting state, the display unit invisible from the user is powered off, so as to achieve the effect of reducing power consumption.

Further, the above one or more technical solutions in the embodiments of the present application may further make one or more of the following technical effects:

1. By detecting a first position relationship between the first body set with the display unit and the M external operators, acquiring a standard display range according to the first position relationship, and further determining whether the current display angle of the display unit is within the standard display range; and prompting the user that the display angle of the display unit is beyond the standard view angle range of at least one operator if the display angle is beyond the standard display range, the user or the electronic device is urged to adjust the display angle to and within the standard display range. In this way, the technical problem of an inaccurate display angle in the prior art is solved, thus making a technical effect of enhancing display effect.

2. The user is prompted that the current display angle has been within the standard view angle ranges of the M external operators when the display angle is adjusted to and within the common standard view angle range of the M external operators, thus avoiding from adjusting to an incorrect display angle or wasting time on adjusting the display angle of the display unit again and again, improving the efficiency of adjusting the display angle and enhancing the customer experience.

3. When the present application detects that the display angle of the display unit is beyond the standard view angle ranges of the M external operators, the electronic device automatically adjusts the display angle of the display unit after receiving the adjusting instruction, which improves the efficiency for adjusting, and at the same time avoids from inaccurately adjusting the angle when the angle is artificially adjusted, thus achieving the technical effect of accurately adjusting.

The method of the present invention is not limited to the embodiments as described in the specific implementations. Other implementations obtained by those skilled in the art according to the technical solutions of the present invention also belong to the technical inventive scope of the present invention.

Obviously, those skilled in the art can make various alternations and modifications to the present invention without departing from the spirit and scope of the present invention. As such, if these alternations and modifications of the present invention fall into the scope of the claims of the present invention and their equivalent technologies, the present invention intends to include these alternations and modifications.

The invention claimed is:

1. A display control method applicable to an electronic device, wherein the electronic device comprises a first body and a second body; the first body and the second body are connected through a shaft, such that the first body and the second body are fixed at any angle; two sides of the first body are set with a first display area and a second display area respectively; and the second body is set with a keyboard, comprising:

acquiring space position information of the first body and the second body from an acceleration sensor set on the first body or the second body, the space position information including a direction of gravity sensed by the acceleration sensor;

determining whether the direction of gravity sensed by the acceleration sensor is in a predetermined direction that corresponds to a triangle supporting state;

detecting a first included angle between the first body and the second body after it is determined that the direction of gravity sensed by the acceleration sensor is in the predetermined direction;

determining whether the first included angle is in a predetermined angle range, and switching an operating state of the electronic device to the triangle supporting state if the first included angle is in the predetermined angle range; and, determining a display area of the first display area and the second display area that faces outwards as a target display area in the triangle supporting state; and performing the display operation on the target display area in the triangle supporting state;

after the operating state of the electronic device is switched to the triangle supporting state, powering off a display area other than the target display area when the target display area is any one of the first display area and the second display area, wherein the first display area and the second display area are set on the two sides of the same first body respectively;

receiving a first position detecting instruction;

performing the first position detecting instruction, and detecting and obtaining a first data that indicates a first position relationship between the first body and M external operators, wherein M is an integer larger than or equal to 1;

acquiring a predetermined condition corresponding to the first data, wherein the predetermined condition comprises a position reference data between the first body and the second body;

detecting a second position relationship between the first body and the second body, and obtaining a second data corresponding to the second position relationship;

determining whether the second data satisfies the predetermined condition, and obtaining a second determining result; and generating a first prompt information to prompt that a display angle of the display unit is beyond a standard view angle range of at least one of the M external operators if the second determining result indicates that the second data does not satisfies the predetermined condition, wherein the detecting and obtaining a first data that indicates a first position relationship between the first body and the M external operators comprises:

detecting a value of distance between a reference point of the display unit and a predetermined benchmark point of each of the M external operators to obtain M distance values;

detecting a height difference between the reference point and the predetermined benchmark point of each of the M external operators to obtain M height differences; and obtaining the first data that indicates the first position relationship between the first body and M external operators based on the M distance values and the M height differences; and wherein the M distance values are represented as $k_i$ with i=1, 2, . . . , M; the M height differences are represented as $d_i$ with i=1, 2, . . . , M; and a range of the first included angle between the first body and the second body is obtained as a range of $\beta_i$ according to a formula $\beta_i \approx \pi - \arcsin(d_i/k_i \cdot \sin \alpha)$ with i=1, 2, . . . , M, wherein a numeric range of $\alpha$ is 0-15 degrees; and intersection of values of $\beta_i$ with i=1, 2, . . . , M is calculated to obtain the predetermined condition of the first data.

2. The method according to claim 1, wherein the first operation system is a WINDOWS operation system, and the second operation system is an Android operation system.

3. The method according to claim 1, before the operating state of the electronic device is switched to the triangle supporting state, further comprising:

determining a current display area in the system that is performing the display operation from the first display area and the second display area; and detecting whether the current display area includes the target display area, and switching a display content in the current display area to the target display area according to a predetermined switching rule if the current display area does not include the target display area.

4. The method according to claim 1, wherein the detecting a second position relationship between the first body and the second body, and the obtaining a second data corresponding to the second position relationship comprise:

detecting a rotation angle of the shaft; and obtaining the second data corresponding to the second position relationship based on the rotation angle.

5. The method according to claim 1, after the first prompt information is generated, further comprising:

detecting whether there is an adjusting operation that adjusts positions of the first body and/or the second body;

monitoring a position change of the first body and the second body and acquiring a third data corresponding to a real time position relationship between the first body and the second body if there is the adjusting operating;

determining whether the third data satisfies the predetermined condition, and obtaining a third determining result; and generating a second prompt information to prompt that a display angle of the display unit is within a standard view angle range of each of the M external operators if the third determining result indicates that the third data satisfies the predetermined condition.

6. The method according to claim 1, wherein the performing the display operation on the target display area comprises acquiring an image to be displayed and rotating 180 degrees a coordinate of each of pixel points in the image to be displayed within a horizontal plane.

7. The method according to claim 1, wherein the switching the operating state of the electronic device to the triangle supporting state comprises:

detecting whether a current operation system of the electronic device is a first operation system, and switching the current operation system to a second operation system different from the first operation system if it is the first operation system.

8. An electronic device comprising a first body and a second body; the first body and the second body are connected through a shaft, such that the first body and the second body are fixed at any angle; two sides of the first body include a first display area and a second display area respectively; and the second body includes a keyboard, the electronic device further comprising:

a space position determining module for acquiring space position information of the first body and the second body from an acceleration sensor set on the first body and/or the second body, the space position information including direction of gravity sensed by the acceleration sensor, and determining whether the direction of gravity sensed by the acceleration sensor is in a predetermined direction that corresponds to a triangle supporting state;

an included angle detecting module for detecting a first included angle between the first body and the second body after it is determined that the direction of gravity sensed by the acceleration sensor is in the predetermined direction;

an operating state switching module for determining whether the first included angle is in a predetermined angle range, and switching an operating state of the electronic device to the triangle supporting state if the first included angle is in the predetermined angle range determining a display area of the first display area and the second display area that faces outwards as a target display area; and performing the display operation on the target display area in the triangle supporting state, and after the operating state of the electronic device is switched to the triangle supporting state, powering off a display area other than the target display area when the target display area is any one of the first display area and the second display area, wherein the first display area and the second display area are set on the two sides of the same first body respectively, a detecting unit for detecting and obtaining a first data that indicates a first position relationship between the first body and M external operators after a first position detecting instruction is received, wherein M is an integer larger than or equal to 1, detecting a second position relationship between the first body and the second body, and obtaining a second data corresponding to the second position relationship;

a data processing unit connected to the detecting unit for acquiring a predetermined condition corresponding to the first data, wherein the predetermined condition comprises a position reference data between the first body and the second body;

a determining unit connected to the detecting unit and the data processing unit for determining whether the second data satisfies the predetermined condition, and obtaining a second determining result; and an information generating unit connected to the determining unit for generating a first prompt information to prompt that a display angle of the display unit is beyond a standard view angle range of at least one of the M external operators if the second determining result indicates that the second data does not satisfy the predetermined condition, wherein the detecting unit comprises:

a first detecting subunit for detecting a value of distance between a reference point of the display unit and a predetermined benchmark point of each of the M external operators to obtain M distance values; and detecting a height difference between the reference point and the predetermined benchmark point of each of the M external operators to obtain M height differences; and a first data acquiring subunit connected to the first detecting subunit for obtaining the first data that indicates the first position relationship between the first body and the M external operators based on the M distance values and the M height differences; and wherein the M distance values are represented as $k_i$ with $i=1, 2, \ldots, M$; the M height differences are represented as $d_i$ with $i=1, 2, \ldots, M$; a range of the first included angle between the first body and the second body is obtained as a range of $\beta_i$ according to a formula $\beta_i \approx \pi - \arcsin(d_i/k_i \cdot \sin \alpha)$ with $i=1, 2, \ldots, M$, wherein a numeric range of $\alpha$ is 0-15 degrees; and intersection of values of $\beta_i$ with $i=1, 2, \ldots, M$ is calculated to obtain the predetermined condition of the first data.

9. The electronic device according to claim 8, wherein the first operation system is a WINDOWS operation system, and the second operation system is an Android operation system.

10. The electronic device according to claim 8, wherein the operating state switching module is further used for determining a current display area in the system that is performing the display operation from the first display area and the second display area; detecting whether the current display area includes the target display area, and switching a display content in the current display area to the target display area according to a predetermined switching rule if the current display area does not include the target display area.

11. The electronic device according to claim 8, wherein the detecting unit further comprises:

a second detecting subunit for detecting a rotation angle of the shaft; and a second data acquiring subunit connected to the second detecting subunit for obtaining the second data corresponding to the second position relationship based on the rotation angle.

12. The electronic device according to claim 8, further comprising a monitoring unit connected to the detecting unit, the determining unit and the information generating unit for monitoring a position change of the first body and the second body and acquiring a third data corresponding to a real time position relationship between the first body and the second body when the detecting unit detects that there is an adjusting operation that adjusts positions of the first body and/or the second body, so that the information generating unit generates a second prompt information to prompt that the display angle of the display unit is within a standard view angle range of each of the M external operators when the determining unit determines that the third data satisfies the predetermined condition.

13. The electronic device according to claim 8, further comprising an adjusting unit connected to the detecting unit and the determining unit for adjusting a relative position of the first body and the second body in response to a position adjusting operation.

14. The electronic device according to claim 8, wherein the operating state switching module is configured for performing the display operation on the target display area at least by acquiring an image to be displayed and rotating 180 degrees a coordinate of each of pixel points in the image to be displayed within a horizontal plane.

15. The electronic device according to claim 8, wherein the operating state switching module switches the operating state of the electronic device to the triangle supporting state if the first included angle is in the predetermined angle range comprises: detecting whether a current operation system of the electronic device is a first operation system and switching the current operation system to a second operation system different from the first operation system if it is the first operation system.

* * * * *